US012677906B2

(12) United States Patent
Geis et al.

(10) Patent No.: US 12,677,906 B2
(45) **Date of Patent: *Jul. 14, 2026**

(54) ROCKER FOOTWEAR

(71) Applicant: The North Face Apparel Corp., Wilmington, DE (US)

(72) Inventors: Benoit Geis, Watwiller (FR); Wu Shengching, Taichung City (TW)

(73) Assignee: The North Face Apparel Corp., Wilmington, DE (US)

( * ) Notice: Subject to any disclaimer, the term of this patent is extended or adjusted under 35 U.S.C. 154(b) by 747 days.

This patent is subject to a terminal disclaimer.

(21) Appl. No.: 17/276,424

(22) PCT Filed: Oct. 15, 2019

(86) PCT No.: PCT/US2019/056321

§ 371 (c)(1),
(2) Date: Mar. 15, 2021

(87) PCT Pub. No.: WO2020/081560

PCT Pub. Date: Apr. 23, 2020

(65) Prior Publication Data

US 2022/0031016 A1 Feb. 3, 2022

(30) Foreign Application Priority Data

Oct. 15, 2018 (FR) ..... 1801085

(51) Int. Cl.
*A43B 13/12* (2006.01)
*A43B 13/14* (2006.01)
(Continued)

(52) U.S. Cl.
CPC ..... *A43B 13/125* (2013.01); *A43B 13/145* (2013.01); *A43B 13/18* (2013.01); *A43D 86/00* (2013.01)

(58) Field of Classification Search
CPC ... A43B 13/143; A43B 13/145; A43B 13/125; A43B 13/14; A42B 13/18; A42B 13/181; A42B 13/141
See application file for complete search history.

(56) References Cited

U.S. PATENT DOCUMENTS 3,835,556 A * 9/1974 Panaretos ..... A43B 13/145 36/28
4,567,678 A * 2/1986 Morgan ..... A43B 7/00 36/110
(Continued)

FOREIGN PATENT DOCUMENTS

CN 102309088 A 1/2012
CN 108471836 A 8/2018
(Continued)

OTHER PUBLICATIONS

South, Nanette. Radius of Curvature. Published Jun. 18, 2009. Accessed from https://www.monolithic.org/blogs/engineering/radius-of-curvature on Jan. 30, 2024 (Year: 2009).*
(Continued)

*Primary Examiner* — Patrick J. Lynch
*Assistant Examiner* — Brianna T. Duckworth
(74) *Attorney, Agent, or Firm* — Smith, Gambrell & Russell LLP

(57) ABSTRACT

A shoe may comprise an upper (5) and a comfort sole (9) attached to an outsole (7), the comfort sole having a radius of curvature at any point of a line from a heel (C) to a toe (D) and interfacing with outsole (7), wherein the lowest point of comfort sole (9) and outsole (7), called the center of mass or balance point of the sole or natural balance point of the shoe, when placed on a substantially horizontal reference plane (H) defines a transition zone (Z1) of the roll of the foot having the highest radius of the comfort sole and the outsole,
(Continued)

and in that the center of mass is behind point (B) of the metatarsals.

11 Claims, 5 Drawing Sheets

(51) Int. Cl.
*A43B 13/18* (2006.01)
*A43D 86/00* (2006.01)

(56) References Cited

U.S. PATENT DOCUMENTS

| | | | | |
|---|---|---|---|---|
| 5,131,173 | A | 7/1992 | Anderie | |
| 5,295,314 | A | 3/1994 | Moumdjian | |
| 6,321,469 | B1 | 11/2001 | Cretinon | |
| 6,421,935 | B1 * | 7/2002 | Bartlett | A43B 13/143 482/79 |
| 6,497,058 | B2 | 12/2002 | Dietrich et al. | |
| 6,973,746 | B2 | 12/2005 | Auger et al. | |
| 7,082,702 | B2 | 8/2006 | Cretinon | |
| 7,779,557 | B2 | 8/2010 | Teteriatnikov et al. | |
| 7,793,437 | B2 | 9/2010 | Chapman et al. | |
| 7,877,897 | B2 | 2/2011 | Teteriatnikov et al. | |
| 8,079,159 | B1 | 12/2011 | Rosa | |
| 8,776,397 | B2 | 7/2014 | Borel et al. | |
| 9,289,028 | B1 | 3/2016 | Anderson | |
| 2002/0050078 | A1 | 5/2002 | Dietrich et al. | |
| 2010/0146819 | A1 | 6/2010 | Teteriatnikov et al. | |
| 2010/0154252 | A1 | 6/2010 | Avent et al. | |
| 2010/0275471 | A1 | 11/2010 | Teteriatnikov et al. | |
| 2010/0307028 | A1 | 12/2010 | Teteriatnikov et al. | |
| 2011/0061264 | A1 | 3/2011 | Solymosi et al. | |
| 2011/0078923 | A1 | 4/2011 | Bartholet et al. | |
| 2011/0179669 | A1 | 7/2011 | Hanebrink et al. | |
| 2011/0185593 | A1 * | 8/2011 | Ramos | A43B 13/145 36/103 |
| 2014/0047740 | A1 | 2/2014 | Tucker et al. | |
| 2014/0250723 | A1 | 9/2014 | Kohatsu | |
| 2016/0345668 | A1 * | 12/2016 | Dyer | A43B 13/186 |
| 2017/0095033 | A1 | 4/2017 | Farina et al. | |
| 2017/0245586 | A1 | 8/2017 | Cook et al. | |
| 2017/0245589 | A1 | 8/2017 | Cook et al. | |
| 2019/0343221 | A1 | 11/2019 | Farr et al. | |
| 2020/0113278 | A1 | 4/2020 | Geis et al. | |
| 2022/0053878 | A1 | 2/2022 | Geis et al. | |

FOREIGN PATENT DOCUMENTS

| | | | | |
|---|---|---|---|---|
| EP | 1502517 | A1 | 2/2005 | |
| EP | 2314178 | A1 | 4/2011 | |
| EP | 3114955 | A1 | 1/2017 | |
| FR | 2898252 | A1 | 9/2007 | |
| FR | 3087096 | A1 | 4/2020 | |
| GB | 2458741 | A * | 10/2009 | A43B 13/143 |
| JP | 09-047304 | A | 2/1997 | |
| JP | 2006-204712 | A | 8/2006 | |
| JP | 2012-513246 | A | 6/2012 | |
| JP | 2018-516733 | A | 6/2018 | |
| KR | 10-0914176 | B1 | 8/2009 | |
| KR | 10-2018-0015165 | A | 2/2018 | |
| TW | 201711586 | A | 4/2017 | |
| WO | 2011/001353 | A2 | 1/2011 | |
| WO | 2017/045018 | A1 | 3/2017 | |
| WO | 2020/081560 | A1 | 4/2020 | |
| WO | 2020/081566 | A1 | 4/2020 | |

OTHER PUBLICATIONS

Definition of "attach". Accessed from https://www.dictionary.com/browse/attaching on Feb. 2, 2023. (Year: 2023).*
Final Office Action received for U.S. Appl. No. 16/653,607, mailed on Jun. 14, 2021, 8 pages.
Notice of Allowance received for U.S. Appl. No. 16/653,607, mailed on Aug. 25, 2021, 5 pages.
International Search Report and Written Opinion dated Nov. 25, 2019 for Application No. PCT/US2019/056321; 13 pages.
Non-Final Rejection Mailed on Jan. 11, 2023 for U.S. Appl. No. 17/464,511, 9 page(s).
Office Action received for European Application No. 197954324, mailed on Apr. 25, 2022, 6 pages.
Office Action received for European Application No. 197954324, mailed on Mar. 6, 2023, 5 pages.
Office Action received for European Application No. 197954324, mailed on Oct. 5, 2022, 10 pages.
Office Action received for Korean Patent Application No. 10-2021-7009367, mailed on Sep. 19, 2022, 8 pages (3 pages of English Translation and 5 pages of Original Document).
Office Action received for Japanese Patent Application No. 2021-517563, mailed on Feb. 14, 2024, 13 pages (7 pages of English Translation and 6 pages of Original Document).
Office Action received for Japanese Patent Application No. 2021-517581 , mailed on Mar. 12, 2024, 13 pages (7 pages of English Translation and 6 pages of Original Document).

* cited by examiner

ROCKER FOOTWEAR

CROSS-REFERENCE TO RELATED APPLICATION

This application is a National Stage Filing of International (PCT) Application Number PCT/US2019/056321, filed Oct. 15, 2019, which claims the benefit of French Patent Application Number 1801085, filed Oct. 15, 2018, each of which is hereby incorporated by reference in their entirety.

FIELD OF THE PRESENT DISCLOSURE

The present disclosure relates to a shoe that can be described as high performance.

BACKGROUND

In document U.S. Pat. No. 8,079,159, there is described a shoe extending between a toe and a heel and comprising an upper attached to an outsole.

The shoe described in document U.S. Pat. No. 8,079,159 has a modular sole structure comprising, from bottom to top:

- An outer layer, called a contact or outsole layer, made of an adherent material such as a rubber or similar, which is intended to provide a good grip on the ground and good resistance to abrasion
- An intermediate comfort layer made of damping material, called a shock damping and/or elasticity layer due to a damping part
- An upper layer called a shell, set up directly in contact with the upper face of the comfort layer It is placed closest to the foot and is assembled directly on the upper of the shoe.

In document US-2011/0179669 A1, there is described a shoe extending between a toe and a heel and comprising an upper attached to an outsole.

However, improvements are needed.

SUMMARY OF THE PRESENT DISCLOSURE

The object of the present disclosure is to propose an improvement to the performance of an outsole of the type mentioned above, and in particular, to propose a soling construction which has a guiding, holding, cushioning, and relaunching effect due to a scalable center of mass.

One or more of the goals may be addressed in the shoe claimed in the present disclosure. According to the indications in the introduction, this athletic shoe is characterized in that the comfort sole has a radius of curvature at any point of a line from the heel to the tip and interfacing with the outsole, and in that the lowest point of the comfort sole and/or outsole, called the center of mass or natural balance point of the shoe, when placed on an appreciably horizontal reference plane, is the transition zone of the roll of the foot having the highest sole radius, and in that the center of mass is located behind the point of the metatarsals.

This construction of the sole produces beneficial results for use in running, but also, depending on the case, for walking or other uses.

The sole may comprise a shell comprising, consisting essentially of, or consisting of a shell bottom and a shell side.

Due to the mechanical connection of the shell and the comfort sole, the lines of force are stabilized. The rise of the shell sides makes it possible to obtain an additional stability effect through compression of the upper, which is added to the stability effect linked to the gluing of the shell to the comfort sole and also prevents the arch being pushed up the foot in the static and dynamic phases.

Of course, the construction mentioned above is not limited to application in races, and can also be very beneficial in other areas, particularly walking and other uses.

According to the aim sought during the practice of physical activities such as walking, running, etc., the present disclosure enables or prevents excessive deformation of the comfort layer in the impact and flexion phases of the foot.

Therefore, in the example shown, the shoe is particularly intended for racing, especially on rough terrain. It has a fairly low upper and a damping outsole; nevertheless, it is low enough so as not to damage the stability of the foot on uneven ground or on a slope.

BRIEF DESCRIPTION OF THE DRAWINGS

The present disclosure will be better understood using the description and accompanying schematic figures, which illustrate several non-limiting aspects by way of example. Based on the description and figures, those skilled in the art will be able to deduce other advantageous characteristics of the shoe.

DETAILED DESCRIPTION

Figure 1:
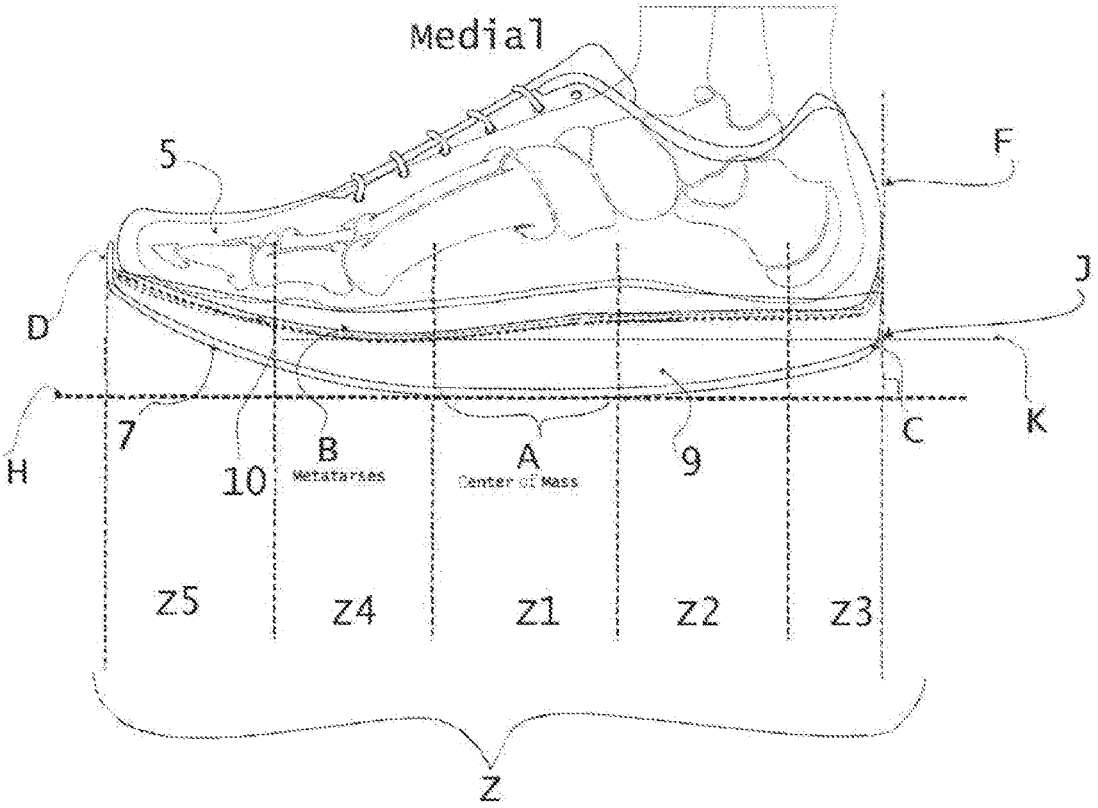
FIG. 1 is a side (medial) view of an aspect of the present disclosure.
Figure 2:
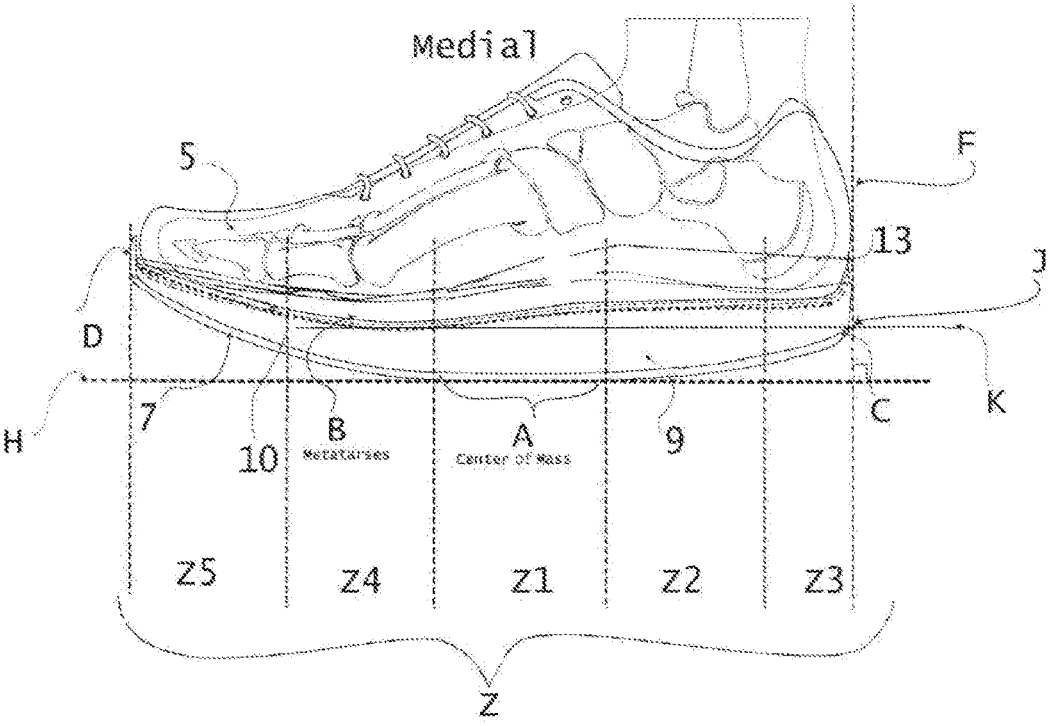
FIG. 2 is a side (medial) view of an aspect of the present disclosure that includes a shell.

FIGS. 1 and 2 show an aspect of the shoe as claimed in the invention. The shoe is conventionally constituted of upper (5), which will receive the user's foot, and of an outsole placed below the upper. The external soling is executed according to a stratified profile made of several layers fulfilling distinct functions. It is conventionally constituted of outsole (7) and comfort sole (9).

The underside of the comfort sole, which is in contact with the outsole, has a substantially convex curvature. The side of the comfort sole has a radius of curvature at all points of a line from the heel (K) to the toe (D) and creates an interface with the outsole. The lowest point of the comfort sole, called the center of mass or natural balance point of the shoe, when placed on an appreciably horizontal reference plane, is the transition zone of the roll of the foot having the highest sole radius. The center of mass is scalable and located behind the point (B) of the metatarsals.

In order to promote the roll of the foot, an example of a sole is shown in FIGS. 1 and 2. The sole is divided into several zones (Z). Thus, 5 zones (Z1 to Z5) are represented in FIGS. 1 and 2. Zone (Z1) is the one which corresponds to the center of mass. Zone (Z2) is a transition zone towards the heel whose radius is smaller than the radius of zone (Z1). Zone (Z3) is an impact zone at the heel whose radius is smaller than the radius of Zone (Z2). Zone (Z4) is the area of unrolling towards the toe of the foot, whose radius is smaller than the radius of Zone (Z1). Zone (Z5) is the final unrolling zone whose radius is greater than the radius of Zone (Z4).

In the static phase, in order to find stability on a flat part, a radius of Zone (Z1) that is sufficiently open will be chosen. Thus, the part of Zone (Z1) of comfort layer (9) will be crushed by the weight of the user. It is advantageous for the radius of Zone (Z1) to be between 350 mm and 3000 mm. Of course, this range of values of the radius of Zone (Z1) is only indicative, and those skilled in the craft will know how to choose other values of the radius if necessary.

The transition phase between the impact and the roll of the foot is immediate and without energy loss thanks to the center of mass and the more pronounced dip of Zone (Z4), which is located under the metatarsals. This makes it possible to increase and facilitate the roll of the foot and to obtain a greater range of motion and an optimized push-off phase. Strides become faster and more powerful.

It is, of course, obvious that the absolute and relative values of the radii listed above are only indicative. Indeed, the fields of application and/or physical activities envisaged, as well as the different morphologies of the potential users, such as type and size of foot, weight, type of stride, etc., may also have an influence on the choice of the radii of Zones (Z1 to Z5). Thus, those skilled in the craft may envision a number of zones less than or greater than 5.

The shoe will, however, include at least 3 zones. The two zones on either side of Zone (Z1) corresponding to the center of mass then have radii smaller than that of the center of mass.

When the shoe comprises more than 5 zones, the radii of each zone other than (Z1) may have a radius equal to or different from an adjacent or non-adjacent zone. It is, of course, essential that side of the comfort sole have a radius of curvature at all points of a line from the heel to the toe and creates an interface with the outsole, and that Zone (Z1) corresponding to the center of mass has a radius greater than the two adjacent zones.

Similarly, in order to promote the roll of the foot and to minimize the transition phase between the first impact and center of mass (A), point (C) corresponding to the heel of the outsole and/or comfort sole (9) is set back or at the same level as the part of the upper furthest from the center of mass. This principle, which has the effect of advancing the contact point to Zone (A) as much as possible, favors the dynamic phase of the walk, on flat ground as well as on inclines.

This configuration allows outsole (7) to advance the first contact zone towards the center of mass as far as possible during the natural roll of the foot and to remain in contact during the first phase of impact on the ground; this happens during the entire phase of the roll of the foot regardless of where the foot is placed, without generating a second impact.

Figure 3:
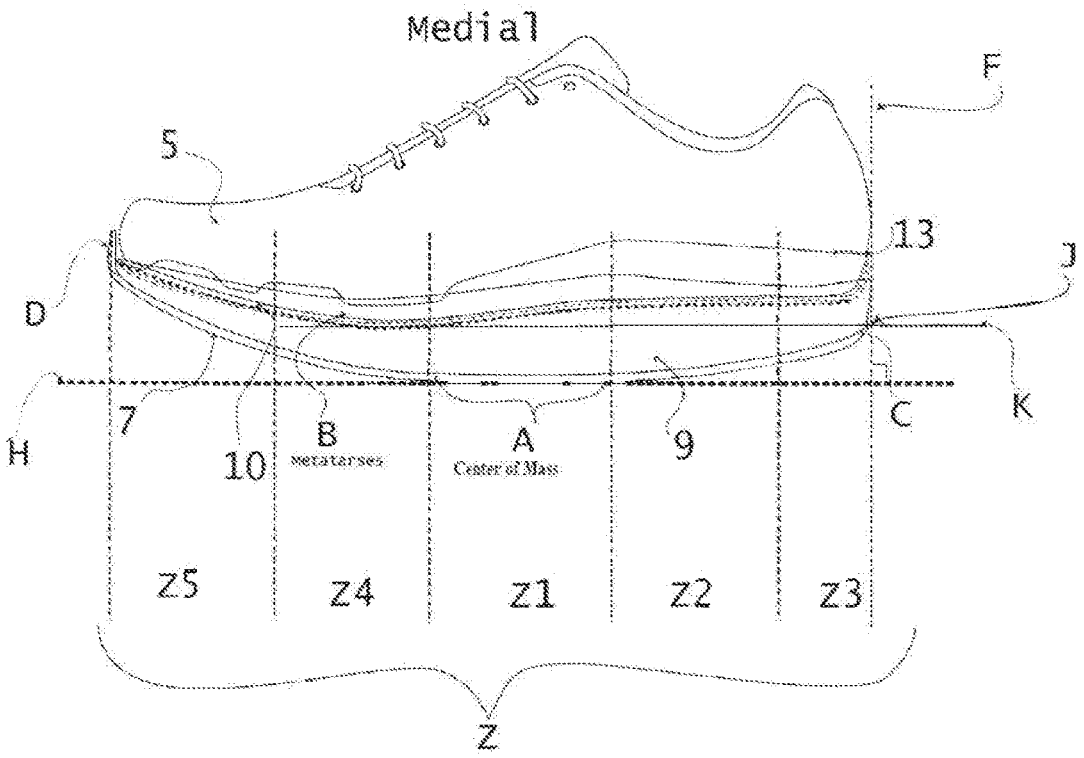
FIG. 3 is a side (medial) view of an aspect of the present disclosure that includes a shell with notches.
Figure 4:
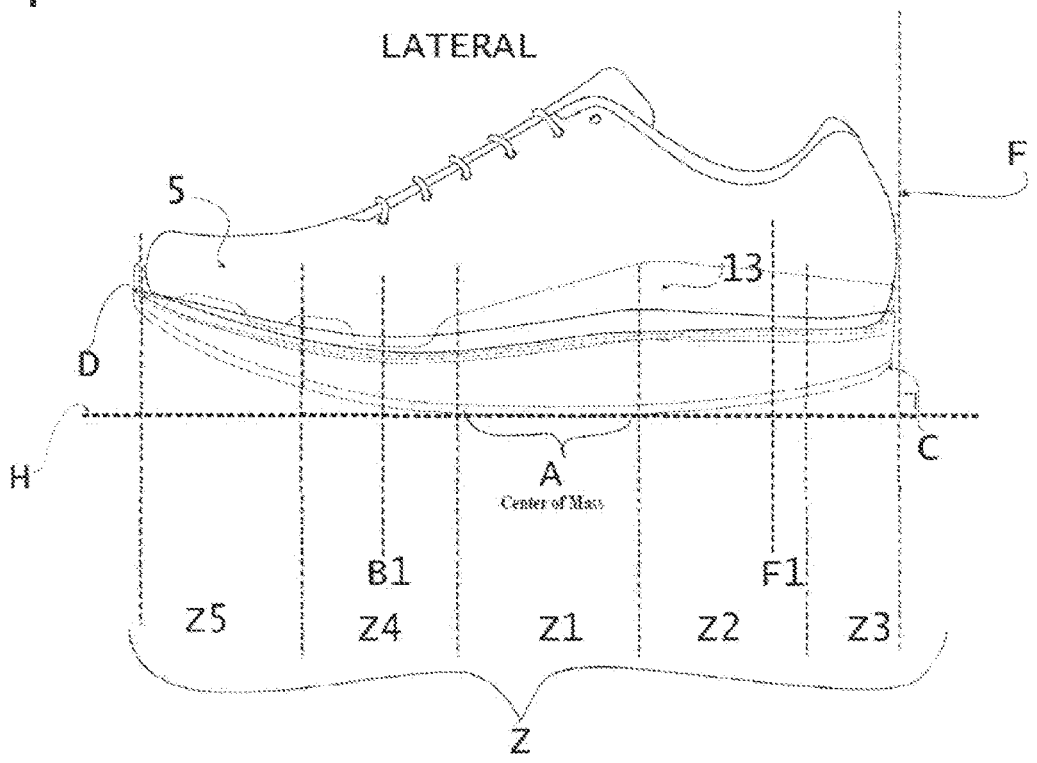
FIG. 4 is a side (medial) view of an aspect of the present disclosure that includes a shell with notches.
Figure 5:
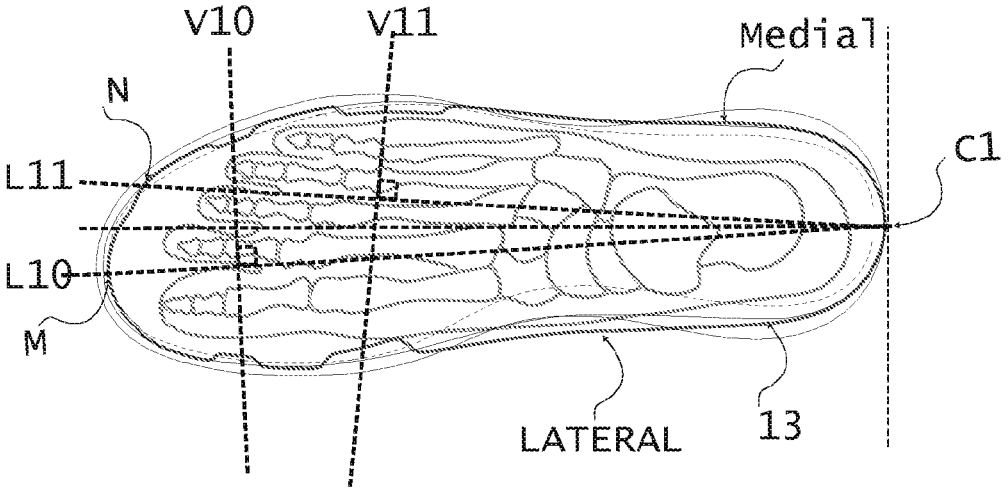
FIG. 5 is a view of the top of the shell with notches.

As indicated in FIGS. 2 to 4, the shoe may comprise shell (13) that is sufficiently rigid, which prevents the arch from being pushed up the foot in the static and dynamic phases. Shell (13) is positioned above the comfort sole and is glued firmly over the entire surface thereof. The shell represents a constraint device for this comfort sole and this center of mass.

Comfort sole (9) is made of a material that ensures comfort and keeps the foot in place. It is made of a damping material such as rubber or ethylene-vinyl acetate (EVA). The comfort sole may also be PU (polyurethane), or any other natural or synthetic foam. PU is harder, and therefore offers less immediate comfort than EVA. However, it is more durable and will have more flexibility over time. The rubber is very soft and very flexible, but it is heavier. The cushioning material of the comfort layer may also be a material having elastic or viscoelastic properties, such as elastomer.

In FIGS. 1 to 4, in order to move the first impact phase as close as possible to center of mass (A) and to favor the strike zone and the natural roll of the foot, the comfort sole is placed in front of line (F). Line (F) is a line perpendicular to substantially horizontal plane (H) on which the shoe is placed. Line (F) passes through point (J), which is in the zone of the heel farthest from center of mass (A).

As mentioned above, the lower part of comfort sole (9), which is contiguous with outsole (7), has a radius of curvature at any point on a line from the heel to the toe, and creates continuity on both sides with center of mass (A). This configuration allows outsole (7) to always remain in contact in the first phase of impact with the ground and during the entire phase of the roll of the foot, regardless of where the foot is placed, without generating a second impact, thanks to the mechanical connection that stabilizes the lines of force of shell (13) and comfort sole (9).

Outsole (7) is made of any synthetic or natural material offering the properties necessary for outsoles, such as adhesion and wear resistance. The nature of the material used for the outsole is not limited to the usual materials in the field of shoes. It will be chosen according to the envisaged use of the shoe, the nature of the ground, the adhesion and the desired wear resistance, etc.

As shown in FIGS. 2 to 4, the shoe may comprise sufficiently rigid shell (13) placed between upper (5) and comfort sole (9). Shell (13) is positioned above comfort sole (9) and is glued firmly over the entire surface thereof. Shell (13), which represents a constraint device for this comfort sole and this center of mass, makes it possible in the static and dynamic phase to prevent the arch of the foot from being pushed towards the top of the foot. Shell (13) thus promotes the stability of the center of mass and the roll of the foot by a gradual crushing without deformation of the arch.

Molded shell (13), which has the shape of the shoe's last, decreases impact and energy loss during the support phase. It positions the body correctly, without any effort, in order to execute strides optimally.

Shell (13) also helps to promote the crush of the center of mass without deforming the arch. In addition, this shell imparts torsional and flexural rigidity to the upper that counteracts foot displacement during impacts between the heel of the shoe and the ground and thus contributes to the stability of the support and increases the comfort sole's flexural rigidity.

Shell (13) comprises, consists essentially of, or consists of a shell bottom and a shell side rising towards upper (5). The rise of the shell side makes it possible to obtain an additional stability effect through compression of the upper, which is added to the stability effect linked to the gluing of shell (13) to the comfort sole.

In another aspect, as shown in FIG. 2, the shell side forms an edge around said shell bottom for greater rigidity of the flexion zone.

The shell is also asymmetrical to help hold the foot. In the lateral zone, the shell side is higher and longer towards the toe in order to favor the stabilization of the arch.

As shown in FIGS. 5 to 8, in order to fully hold the foot while allowing the roll of the foot, notches are notably placed opposite each other on substantially transverse lines (V10, V11). Substantially transverse line (V10) is perpendicular to substantially longitudinal line (L10) passing through heel (C1) and point (M) located at the level of the toe. Substantially transverse line (V11) is perpendicular to substantially longitudinal line (L11) passing through the heel, and a point (N) located at the front of the shell and outside point (M) towards the medial edge.

The number of notches is, of course, variable. They are not necessarily an even number and in perfect opposition.

The shell sides are also glued to the surfaces in contact with the outsole. Shell (13) also imparts torsional and flexural stiffness to the upper, longitudinally and laterally.

The preferred manufacturing materials for the shell are loaded or non-loaded polyurethane (PU, thermoplastic polyurethane (TPU)), loaded or non-loaded polyamide (PA), polyethylene (PE), and generally all loaded or non-loaded synthetic materials.

Composite materials, for example, based on fiberglass/carbon fiber and synthetic resin, are also options.

We can also consider the use of metallic materials and, for example, aluminum alloys, or natural materials such as bamboo or other wood fiber.

For each shell, the thickness will be a function of the desired degree of elasticity and the Young's modulus of the chosen material.

Depending on the desired applications, the shell and the comfort sole may have similar or different stiffnesses. In the latter case, a shell (13) can be chosen that is more rigid than comfort sole (9), or vice versa.

Figure 9:
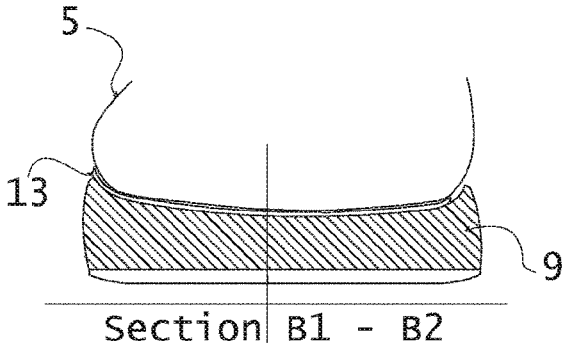
FIGS. 9 and 10 show two cross-sections of an aspect along section lines F1 and B1 of FIG. 4.
Figure 10:
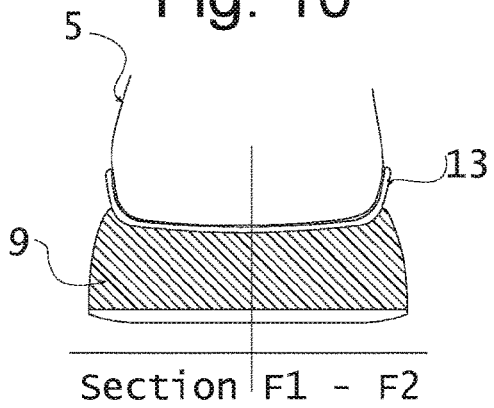

According to FIGS. 9 and 10, the shell and the shell sides are in contact with the heel at the top of the section in FIG. 9 and FIG. 10 (F1 F2). Section B1 B2 according to FIG. 9 shows that the notches on the front part of the foot do not have a shell side.

Figure 6:
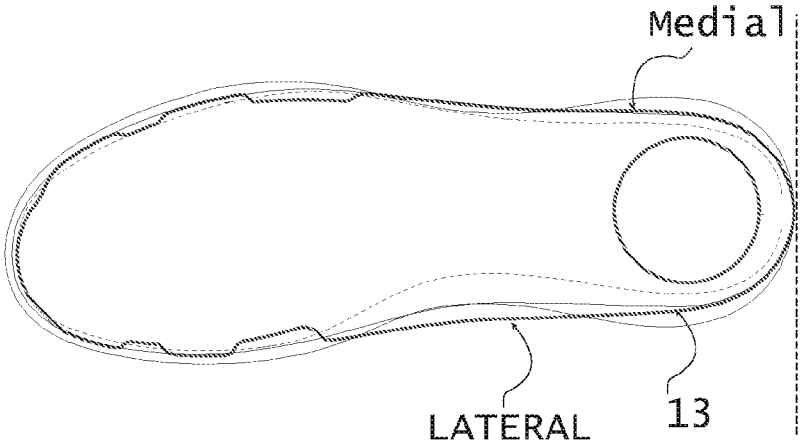
FIG. 6 is a view of the top of the shell with a cavity over the shell bottom.
Figure 7:
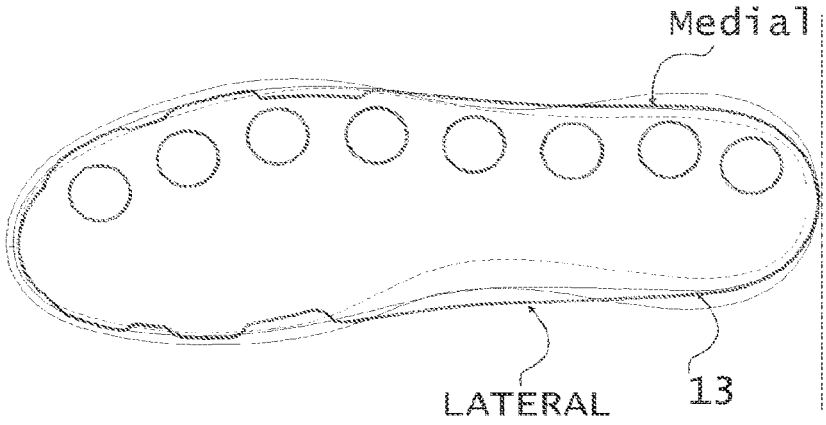
FIG. 7 is a view of the top of the shell with cavities over the shell bottom as claimed in one variant.
Figure 8:
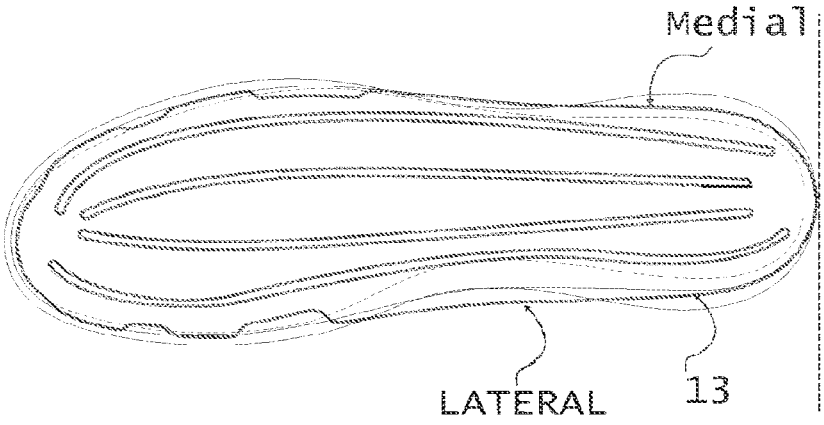
FIG. 8 is a view of the top of the shell with substantially longitudinal cavities over the shell bottom as claimed in another variant.

In another aspect, shell (13) is recessed in different areas of the shell bottom, FIGS. 6 to 8. These openings promote the crushing of comfort sole (9) in the support phases or on uneven surfaces; they also limit the weight of the shell.

Thus, FIG. 6 shows an opening which is placed at the heel.

FIG. 7 shows several openings that are placed along the medial edge.

The openings according to FIGS. 6 and 7 may be circular or not. Those skilled in the craft will be able to choose the appropriate shape of the openings according to the desired characteristics of the shell and/or production requirements.

In FIG. 8, several longitudinal openings are shown which extend approximately between the heel and the toe. The number of longitudinal openings is, of course, not limited to the four seen in in the figure. They may be distributed symmetrically or asymmetrically and have varying lengths. They may be rectilinear or curvilinear. The longitudinal openings may also be disconnected. In this case, the different longitudinal sections of the openings may be aligned or not.

Although the invention has been described in particular with respect to preferred aspects, it is obvious to those skilled in the craft that these aspects as described in the figures and in the description are not limiting in nature. It is clear to those skilled in the craft that variations other than those described and shown may be contemplated without departing from the scope of the invention as defined in the claims.

What is claimed:

1. A shoe comprising:

an upper and a comfort sole attached to an outsole;

the comfort sole having a varying radius of curvature at two or more points of a line extending from a heel area of the comfort sole to a toe area of the comfort sole and interfacing with the outsole, the comfort sole comprising;

a centrally located center of mass zone, wherein the lowest point of the comfort sole and the outsole corresponds to a center of mass of the shoe, such that, when placed on a horizontal reference plane, the center of mass zone defines a transition of the roll of the foot having a highest sole radius of the comfort sole and the outsole, wherein the center of mass zone is positioned behind a metatarsal region of the comfort sole corresponding to a metatarsal region of a foot, and wherein the radius of curvature of the center of mass zone is between 350 mm and 3000 mm;

a transition zone positioned adjacent to the center of mass zone toward the heel area of the comfort sole, the transition zone having a smaller sole radius than the center of mass zone;

a first unrolling zone positioned forward of the center of mass zone in the metatarsal region of the comfort sole, the first unrolling zone having a sole radius that is smaller than the sole radius of the center of mass zone;

a second unrolling zone positioned forward of the first unrolling zone having a sole radius that is greater than the sole radius of the first unrolling zone; and an impact zone at the heel having a sole radius smaller than the radius of the transition zone;

wherein the transition zone and the impact zone each have a sole radius less than the sole radius of the center of mass zone.

2. The shoe of claim 1, further comprising a rigid shell disposed between the upper and the comfort sole, wherein the shell is positioned above the comfort sole and affixed over an entire top surface of the comfort sole, and wherein the shell is configured to act as a constraint device for the comfort sole and the center of mass zone such that the shell provides a static and a dynamic phase during a roll of the shoe to prevent an arch of the foot from being pushed towards a top of the foot.

3. The shoe of claim 2, wherein the shell comprises a shell bottom and a shell side which forms an edge around at least a portion of the shell bottom.

4. The shoe of claim 3, wherein one or more openings are disposed through the shell bottom.

5. The shoe of claim 4, wherein the one or more openings comprise an opening disposed through on the shell bottom at or adjacent the heel area of the comfort sole.

6. The shoe of claim 4, wherein at least a portion of the one or more openings are placed on the shell bottom along the outer contour of the shell bottom.

7. The shoe of claim 4, wherein the one or more openings comprise one or more longitudinal openings disposed on the shell bottom between the heel area of the comfort sole and the toe area of the comfort sole.

8. The shoe of claim 2, wherein the shell side comprises notches formed therein.

9. The shoe of claim 8, wherein the notches are disposed in opposition on first and second transverse lines.

10. The shoe of claim 9, wherein the first transverse line is perpendicular to a first longitudinal line passing through the heel area of the comfort sole and a first point located in an area corresponding with a first region of the toe area of the comfort sole, and the second transverse line is perpendicular to a second longitudinal line passing through the heel area of the comfort sole and a second point located at the front of the shell in a second region of the toe area spaced apart from the first region.

11. The shoe of claim 1, wherein a lower part of the comfort sole, adjacent the outsole, has a radius of curvature at any point on a line from the heel area of the comfort sole to the toe area of the comfort sole, such that the outsole remains in contact with the ground in a first phase of impact and during the entire phase of a roll of the foot, independent of where the foot is placed, without generating a second impact.

* * * * *